United States Patent [19]

Lakso

[11] Patent Number: 4,854,653

[45] **Date of Patent: * Aug. 8, 1989**

[54] MULTIPLE INTERLOCKING SYSTEM FOR FILE CABINETS, E.G.

[75] Inventor: Matthew L. Lakso, Westminster, Mass.

[73] Assignee: Engineered Security Products Corporation, Leominster, Mass.

[ * ] Notice: The portion of the term of this patent subsequent to Dec. 8, 2004 has been disclaimed.

[21] Appl. No.: 93,260

[22] Filed: Sep. 4, 1987

[51] Int. Cl.[4] ..... E05C 7/06

[52] U.S. Cl. ..... 312/222

[58] Field of Search ..... 312/216–222; 20/85

[56] References Cited

U.S. PATENT DOCUMENTS

| | | | |
|---|---|---|---|
| 2,649,246 | 8/1953 | Werner | 312/222 X |
| 4,355,851 | 10/1962 | Slusser | 312/222 X |
| 4,711,505 | 12/1987 | Lakso | 312/220 |

*Primary Examiner*—Joseph Falk

*Attorney, Agent, or Firm*—Joseph S. Iandiorio; Brian M. Dingman

[57] ABSTRACT

A locking system for a stack of drawers in a filing cabinet comprising a single track of discrete studs or "bullets" in a string at the rear of the cabinet, and a bracket at the rear of each drawer energizing an actuator on the track to place it in locking condition relative to the slugs for all other drawers when one drawer is moved towards open position.

15 Claims, 2 Drawing Sheets

MULTIPLE INTERLOCKING SYSTEM FOR FILE CABINETS, E.G.

BACKGROUND OF THE INVENTION

Attention is directed to co-pending applications Ser. No. 011,888, filed Feb. 6, 1987, now U.S. Pat. No. 4,711,505 Dec. 8, 1987, and Ser. No. 058,382, filed June 5, 1987. In those disclosures, a unitary track of contiguous discrete elements, as in a string, are used, one at each side of a file cabinet stack of drawers, e.g., to lock the rest of the drawers closed when any one drawer in the stack was pulled out. The present case discloses a similar single such string located at the back of the stack of drawers, thereby reducing expense, and also presenting other advances in the art, i.e., a novel overall key operated lock, worked from the front of the track or at the side aspect thereof; a more positive individual latch for each drawer, and a novel structure for tensing or rigidifying of the string and releasing the same.

SUMMARY OF THE DISCLOSURE

This invention includes a string of discrete elements, i.e. balls, ovoids, slugs, bullets, etc, as disclosed in the applications above identified. A string of such elements in a track and having springs at each end of the string is arranged e.g. in a filing cabinet or similar structure having movable members that are movable individually. It is desired to lock all other members so that they cannot be moved when one member is moved, say from closed to open conditions. A ball or other device such as a pin or lug, etc., is located to be actuated to tend to be thrust between two of the discrete elements, thereby moving the string or column of discrete elements at both sides of the ball, pin, or lug, so that the elements are repositioned. The ball, pin, or lug, etc., is actuated by an oscillatable actuator having a sort of cam action on the ball, pin, or lug, and the actuator is energized by the drawer or the like as it is moved from one condition to another. Upon the reverse motion, the actuator relieves the ball, pin, or lug, and the springs return the discrete elements to original position. When the discrete elements are displaced as above described, they are not capable of receiving the ball, pin, or lug of any of the other movable drawers, etc., between elements, and thus the other balls, pins, or lugs are not capable being moved, and the locks cannot be unlocked.

In the present case, new and improved actuators are located at the rear of each drawer in a single string of discrete elements, and the action is in a plane at right angles to those disclosed in the applications identified above. In those structures, there are two strings of locks and actuators, e.g. at the two opposite side walls of the file cabinet, but the present invention accomplishes the same result with a single string at the rear wall of the cabinet.

Novel key locking means is provided in the present cast as by a rotary pin or stud having a "half-moon" end that acts to move the string of discrete elements to lock all the drawers, and the rotary motion of the stud can be controlled by a key.

PREFERRED EMBODIMENT OF THE INVENTION

Figure 1:
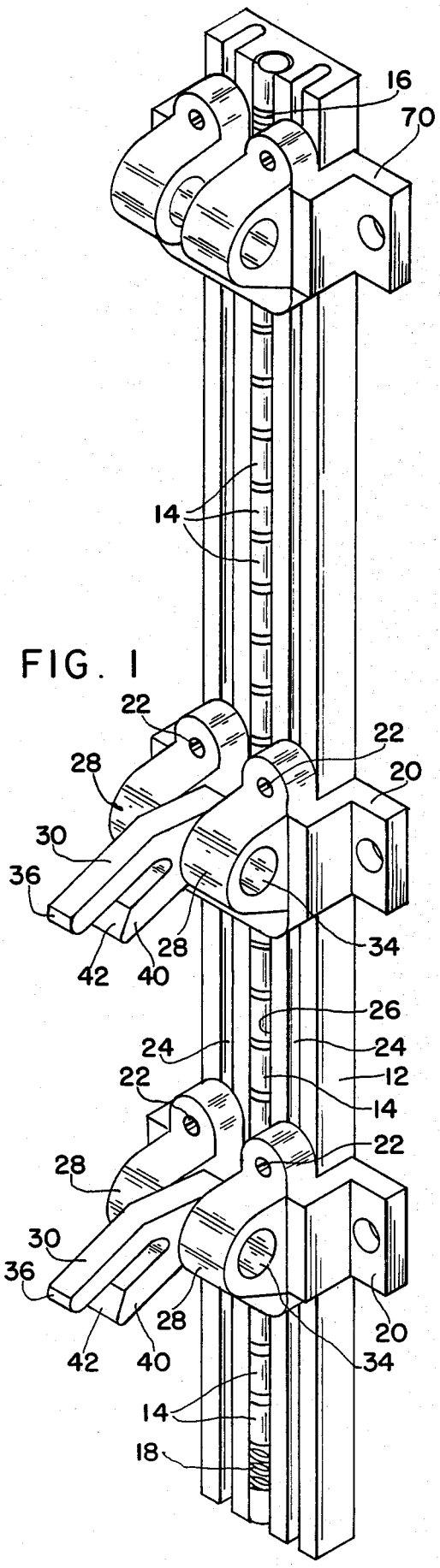
FIG. 1 is a perspective view illustrating the invention.

In FIG. 1, the inside of the back panel of a file cabinet is shown at 10. The rest of the cabinet is not shown but is conventional. the cabinet may be built to hold a plurability of drawers that open and close along parallel lines, as well known. A single track 12 is secured to the panel 10 in any way, and this track provides a support for a string of elements 14 that are small, discrete, and contiguous. These elements may be of any desired shape, but are preferred as cylindrical with domed ends. These are springs 16, 18, one at each end of the track, and these springs yielding by hold the elements in a loose relation, and allow the elements to be spread, to reposition the entire string.

Figure 7:
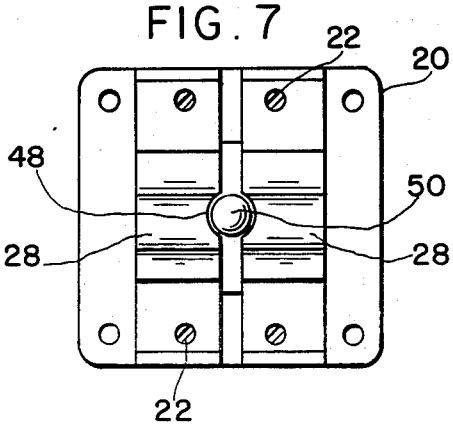
FIG. 7 is a view in elevation of an actuator mount.
Figure 3:
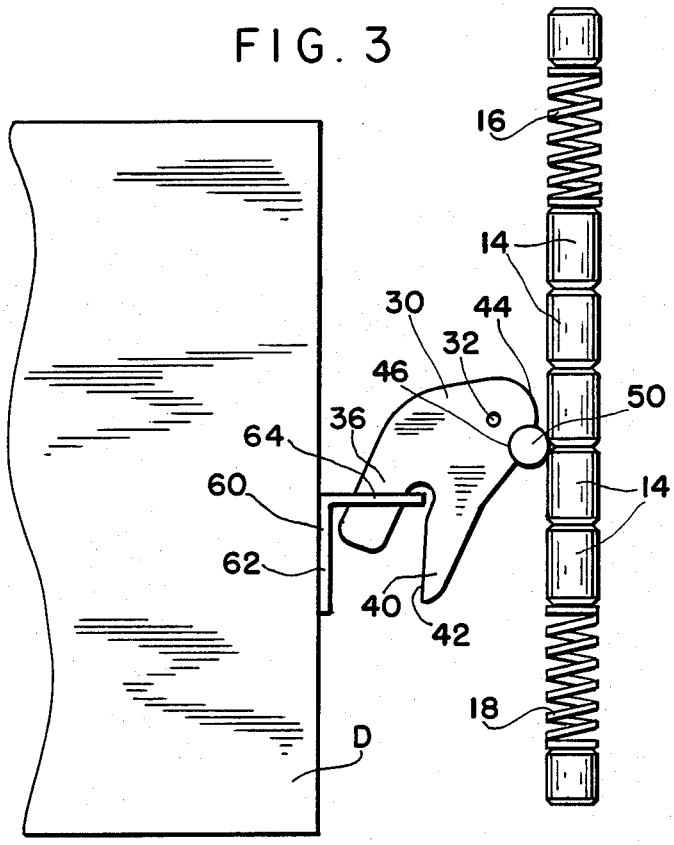
FIG. 3 is a diagrammatic view showing a drawer locked.
Figure 2:
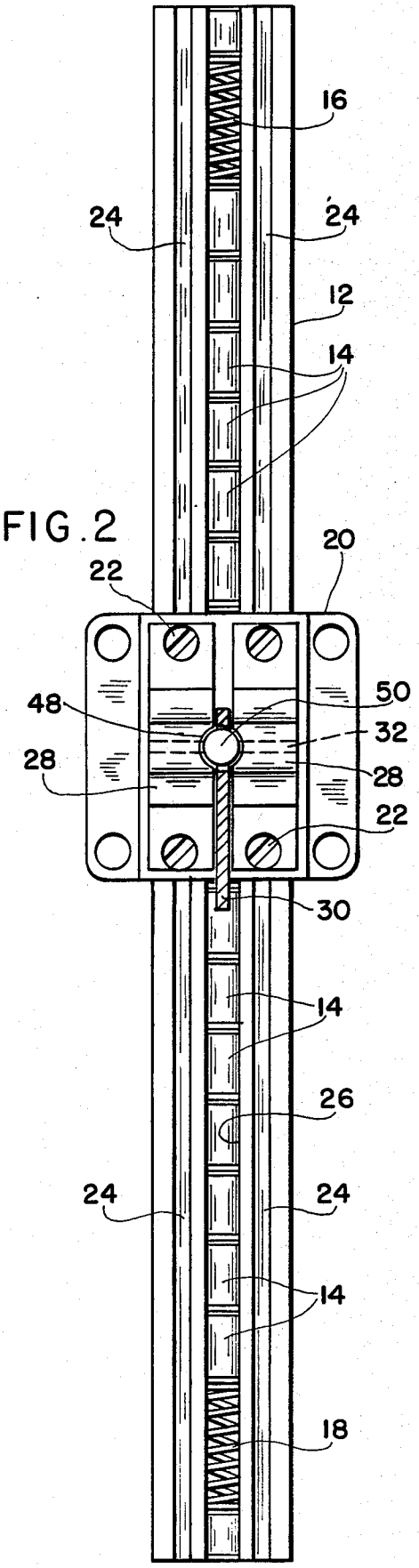
FIG. 2 is a view in front elevation of the track and an actuator mount, part being in section.
Figure 4:
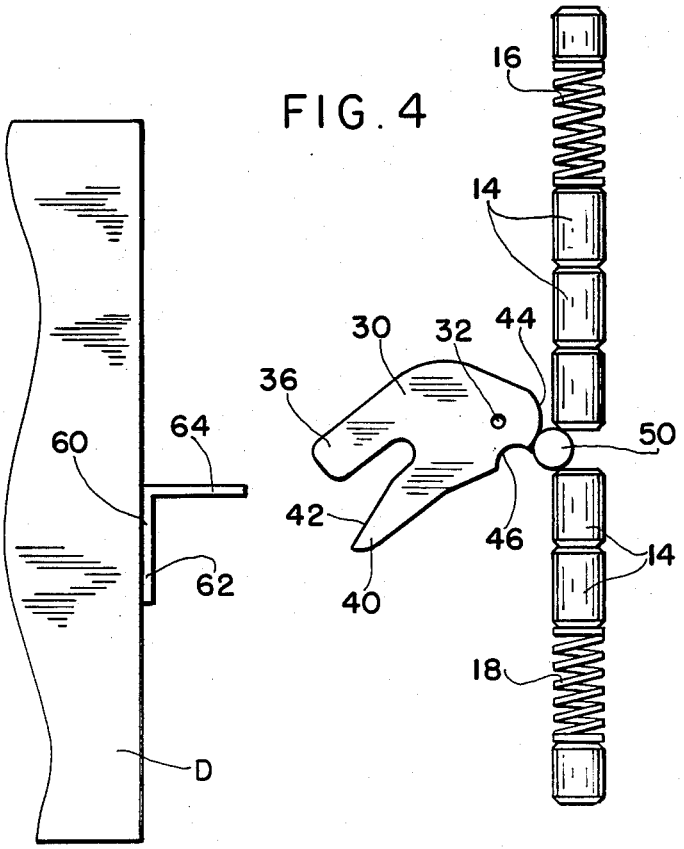
FIG. 4 is a view similar to FIG. 3 showing the drawer of FIG. 3 open and all other drawers locked.

Actuator mounts 20, 20 are secured in position by screws in openings 22, which screws engage in slots 24 in the track. These slots flank the central track opening 26 through which the slugs or other like elements 14 are capable of access while being held therein. Each mount 20 has a pair of spaced ears 28 that accommodate a pivotally mounted actuator 30 as by a pin 32 in openings 34 in the ears. Each actuator is bifurcated forming locking finger 36 and a spaced finger 40, the latter preferably having a tapered free end at 42. At the end of each actuator 30 adjacent its axis it has a cam-like protuberance 44 and on adjacent semi-arc cavity 46 on the edge thereof. The mount also has a circular receptor or opening generally centrally located therein, as at 48, FIG. 7, and a ball 50, FIGS. 3 and 4, is located in this receptor under the adjacent edge of the respective actuator. As will be described more in detail, the cam-like protuberance 44 pushes ball 50 in between a pair of slugs 14, spreading the string and dislocating or repositioning the string parts, slugs 14; but in another rotary position of actuator 30, the ball 50 is forced out of the line of slugs 14 in to notch 46, by the springs 16, 18, and the whole string is placed in original normal position. Normal position of the string is shown in FIG. 3, and the dislocated position of the string is shown in FIG. 4, wherein the two springs 16 and 18 are placed under increased compression with respect to the situation of FIG. 3. As a further observation to make this action clearer, the slugs might be called "bullets" and the actuators "paws".

To actuate the locking system, each drawer D has secured to its rearmost part a bracket 60 having a securement leaf 62 and an apertural leaf 64, the latter extending toward its respective track 12. WIth the string of slugs 14 in balanced, normal condition, FIG. 3, the locking finger 36 of actuator 30 extends down, or of course, up, through the apertured leaf of bracket 60. Ball 50 is received in notch 46, held on position by the action of springs 16 and 18. This is locking position, but any one drawer may be pulled out, the bracket 60 causing actuator 30 to rotate partially in a clockwise direction, as seen in FIGS. 3 and 4. The ball 50 penetrates the string of slugs forcing the string into two parts wherein all the slugs are dislocated or repositioned. Hence, all other balls 50 in the system are now opposite, and in engagement with, a separate slug, intermediate its ends, so that no amount of force on any closed drawer can force the respective ball to penetrate the string, so that such other closed drawers cannot be opened.

Figure 8:
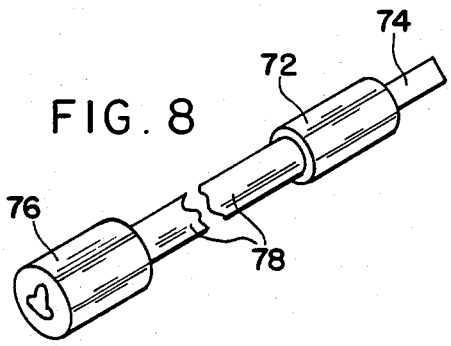
FIG. 8 is a perspective view of an overall locking member.
Figure 5:
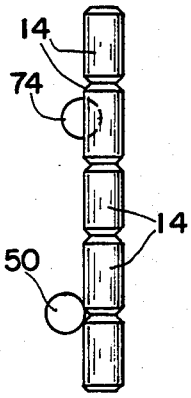
FIG. 5 and 6 are details showing the action of the lock to lock all drawers.
Figure 6:
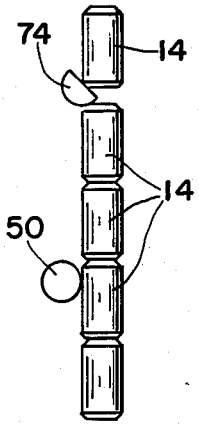

When the open drawer is again closed, its bracket 60 impinges on finger 40, and rotates the actuator 30 in counterclockwise direction, releasing its ball 50 and allowing the springs 16, 18 to return the string to FIG. 3, or normal, condition. Now each ball 50 is opposite the ends of two adjacent slugs, and any one drawer can be opened. In FIG. 5, ball 50 is shown in normal position relative to the string of slugs, corresponding to FIG. 3, and FIG. 6 shows the locked condition of ball 50 of the other closed drawers when the condition of FIG. 4 obtains.

Using a mount 20, or the like, but represented by numeral 70 in FIG. 1 to distinguish this mount from the others, a rotary lock member 72 having a half-moon actuation end 74, is rotarily mounted in the mount 20 either at right angles to track 12, or parallel thereto. In either event, the half-moon configuration 74 is arranged as in FIG. 5 with it flat against the string, so that when given a half turn, it penetrates the string of slugs and forces them apart, FIG. 6, to lock all the drawers and prevent any drawer from being opened. The rotary motion of the member 72 can be made under control of a key-lock 76 at a distance, by means of a rod 78 connecting the parts.

In view of the disclosure herein, it is seen that a stack of drawers or like members, can be locked and one drawer only opened, by means of a single track and string of studs, etc., the actuator 30 having its motion in a plane at right angles to the general plane of the track and by locating the track to the rear of the stack of drawers, preferably centrally thereof.

I claim:

1. A locking system, comprising:

a plurality of small, discrete elements;

means for confirming said elements in a string;

means for biasing said string into a first, contiguous state; and at least two interposing means at spaced positions along said string and aligned with a junction of two elements when said string is in said first state, each said interposing means interacting with amovable device to be locked and being interjected between two elements when the device is moved from an unlocking to a locking position to divide the string and move the elements away from the interjected interposing means into a second, displaced state in which said other junctions are shifted to prevent interjection into the string of any of the remaining interposing means.

2. The locking system of claim 1 in which said discrete elements are identical.

3. The locking system of claim 1 in which said discrete elements are generally cylindrical.

4. The locking system of claim 3 in which the cylinders have tapered ends to facilitate entry of an interposing means.

5. The locking system of claim 1 in which said means for biasing includes spring means at each end of said string.

6. The locking system of claim 1 in which said means for biasing includes an axially compressible element aligned with said string.

7. The locking system of claim 1 in which said interposing means is completely retracted from said string when said string is in said first state.

8. The locking system of claim 1 in which said interposing means are spherical.

9. The locking means of claim 8 in which said interposing means are interjected between elements for a distance of less than their radius.

10. The locking system of claim 1 further including at least two actuator means, each said actuator means coupling a movable device to an interposing means for interjecting said interposing means when the device is moved to the locking position.

11. The locking system of claim 10 in which said actuator means are pivotally attached to said means for confining at spaced positions along said string.

12. The locking system of claim 10 further including means on said device for releasably engaging said actuator means.

13. The locking system of claim 11 in which said actuator means includes an actuating distal portion for engaging said device to be locked to pivot said actuator means upon movement of said device to interject said interposing means when said device is moved to the locking position and free said interposing means when said device is in the unlocking position.

14. A drawer locking system for preventing more than one drawer in a multidrawer device from being opened at a time, comprising:

a plurality of discrete elements;

means for confining said elements in a string proximate said drawers when said drawers are closed;

means for biasing said elements into a contiguous state when all of the drawers are closed;

a plurality of means for separating said string into a divided, noncontiguous state;

means for holding each of said means for separating at a separate position along said string, each said means for separating aligned with a junction of two elements when said string is in said contiguous state; and an actuator means for each means for separating, each said actuator means releasably coupling a said means for separating to one of said drawers and moving from a first position when the drawer is closed to a second position when the drawer is opened, said actuator means interjecting said means for separating between two elements upon movement from the first to the second position to divide said string and push said elements in both directions away from the division into said divided, noncontiguous state in which said other junctions are shifted to prevent interjection into said string of any of the remaining means for separating to hold the rest of said actuator means in the first position and thereby hold the remainder of the drawers closed;

said means for separating moving out from between said elements when the drawer is closed and said actuator means is moved back to its first position to return said string to its first position and unlock all of the drawers.

15. A drawer-locking system for preventing more than one drawer of a multidrawer device from being opened at a time, comprising:

a plurality of substantially identical, small, one-piece, discrete elements;

a channel member for confining said elements in a string proximate said drawers when said drawers are closed;

means, at each end of said string, for biasing said string into a first, contiguous state when all of the drawers are closed;

an interposing means associated with each said drawer;

means for holding said interposing means at fixed, spaced positions along said string between said drawers and said string and adjacent a junction of two elements when said string is in said first state;

actuator means pivotally attached to said channel member between each said interposing means and its associated drawer, each said actuator means having a locking distal end proximate said interposing means and an actuating distal end; and means on each said drawer for engaging and releasably interlocking with the actuating end of an actuator means when said actuator means is in a first position and the drawer is closed, said means for engaging pivoting said actuator means into a second position when the drawer is opened, said locking end of said actuator means thereby thrusting said interposing means into said string between two elements to displace the elements in both directions into a second noncontiguous state in which said other junctions are shifted to block all the remaining interposing means from entering said string and thereby prevent pivotal movement of the associated actuator means to keep the remaining means for engaging interlocked with the actuating ends of the associated actuator means and thereby keep the closed drawers from being opened.

* * * * *